US006119282A

United States Patent [19]

Serbin

[11] Patent Number: 6,119,282

[45] Date of Patent: Sep. 19, 2000

[54] TOILET DRIP AND SPLASH GUARD

[76] Inventor: Daniel Serbin, 1218 Santa Ana Dr., Santa Rosa, Calif. 95404

[21] Appl. No.: 09/406,418

[22] Filed: Sep. 27, 1999

[51] Int. Cl.[7] ..... E03D 9/00

[52] U.S. Cl. ..... 4/300.3

[58] Field of Search ..... 4/300.3, 315, 237, 4/239, DIG. 5, DIG. 19, 234, 235, 300, 301; D23/311, 310, 309

[56] References Cited

U.S. PATENT DOCUMENTS

| | | | |
|---|---|---|---|
| D. 287,399 | 12/1986 | Broeils | D23/71 |
| D. 353,659 | 12/1994 | Hall . | |
| 5,117,512 | 6/1992 | Bressler . | |
| 5,216,760 | 6/1993 | Brown et al. | 4/300.3 |
| 5,373,589 | 12/1994 | Rego et al. . | |
| 5,564,135 | 10/1996 | Jones et al. . | |
| 5,625,905 | 5/1997 | Woods | 4/300.3 |
| 5,815,851 | 10/1998 | Perry . | |

*Primary Examiner*—Henry J. Recla
*Assistant Examiner*—Huyen Le
*Attorney, Agent, or Firm*—Jack Lo

[57] ABSTRACT

A toilet drip and splash guard is comprised of an annular sheet with a central opening. A down-turned flange is arranged at an inner edge of the sheet, and an upturned flange is arranged at an outer edge of the sheet. A tongue is arranged at a rear end of the sheet. The guard is positioned on a toilet rim, with the tongue inserted between the hinges of the toilet seat to prevent the guard from rotating. The inner diameter of the guard is slightly smaller than an inner diameter of the toilet rim. The guard is centered about the toilet rim by having the down-turned flange engaged around the inner edge of the toilet rim. The toilet rim is thus shielded from urine drips and splashes. The guard is substantially wider than the toilet rim, so that it is projected substantially beyond the toilet rim for shielding the floor under the toilet from urine drips and splashes. The front of the guard is narrower than the sides so as not to obstruct a user standing in front of the toilet. The sheet is easily installed and removed, and it is also very easy to clean.

12 Claims, 2 Drawing Sheets

TOILET DRIP AND SPLASH GUARD

BACKGROUND OF THE INVENTION

1. Field of the Invention

This invention relates generally to splash guards for toilets.

2. Prior Art

When using a toilet, men and boys often drip and splatter urine on the rim, seat, and floor. This is a problem in private homes, but especially in public restrooms. The urine must be frequently cleaned from the toilet and floor, otherwise the stench and mess can become overwhelming.

Various splash guards for containing splashing and dripping urine are known in the prior art. A splash guard disclosed in U.S. Pat. No. 5,815,851 to Perry is comprised of a funnel with a lower end aligned with an outer edge of a toilet rim. Brackets extending down from the lower end engage the toilet rim to keep the guard in position. However, the top of the toilet rim is still exposed to drips and splashes. The toilet seat cannot be lowered when the guard is in the raised position. The guard must be lowered before the toilet seat can be lowered and a person seated on the seat.

A splash guard disclosed in U.S. Pat. No. 5,564,135 to Jones et al. is comprised of a ring mounted to an outer edge of a toilet rim. A pair of folding arms are connected between the ring and a toilet seat, which when raised, an accordion shield is raised by the arms. However, the toilet rim is still exposed to drips and splashes. Although the toilet is protected by the guard, the guard itself must be cleaned regularly because it is permanently attached to the toilet. The folds in the accordion shield and the moving parts are difficult to clean.

A splash guard disclosed in U.S. Pat. No. 5,373,589 to Rego et al. is comprised of a pair of triangular accordion shields attached on opposite sides of a toilet between a toilet seat and a toilet rim. Because the shields are generally planar, they can only extend to the midpoint of the toilet rim. The front and rear of the toilet rim are still exposed to drips and splashes. The folds in the accordion shields are difficult to clean.

A splash guard disclosed in U.S. Pat. No. 5,117,512 to Bressler is comprised of a vertical tubular shield with an open front. It is supported inside a toilet rim by clips extending from its sides. However, the toilet seat cannot be lowered when the guard is in position. Further, the front of the toilet rim is still exposed to drips and splashes.

A splash guard disclosed in U.S. Pat. Des. 353,659 to Hall is comprised of a molded shield with down-turned inside and outside flanges positioned over a toilet rim. The toilet seat must be detached from its original mounting and reattached to hinges on the shield. The guard is thus permanently attached to the toilet, so the guard itself must be cleaned regularly.

Some of the prior art guards prevent the toilet seat from being lowered, some are difficult to clean, some allow urine to roll off onto the toilet rim, and some are difficult to install. Further, none of the prior art splash guards can prevent urine from dripping or splashing onto the floor.

OBJECTS OF THE INVENTION

Accordingly, objects of the present toilet drip and splash guard are:

to shield a toilet rim from dripping and splashing urine;

to prevent urine from rolling off onto the toilet rim;

to also shield the floor under the toilet from dripping and splashing urine;

to allow the toilet seat to be lowered while still in position on the toilet;

to not obstruct a user standing in front or sitting on the toilet;

to be very easy to install and remove;

to be very easy to clean; and to be very economical to produce.

Further objects of the present invention will become apparent from a consideration of the drawings and ensuing description.

BRIEF SUMMARY OF THE INVENTION

A toilet drip and splash guard is comprised of an annular sheet with a central opening. A down-turned flange is arranged at an inner edge of the sheet, and an upturned flange is arranged at an outer edge of the sheet. A tongue is arranged at a rear end of the sheet. The guard is positioned on a toilet rim, with the tongue inserted between the hinges of the toilet seat to prevent the guard from rotating. The inner diameter of the guard is slightly smaller than an inner diameter of the toilet rim. The guard is centered about the toilet rim by having the down-turned flange engaged around the inner edge of the toilet rim. The toilet rim is thus shielded from urine drips and splashes. The guard is substantially wider than the toilet rim, so that it is projected substantially beyond the toilet rim for shielding the floor under the toilet from urine drips and splashes. The front of the guard is narrower than the sides so as not to obstruct a user standing in front of the toilet. The sheet is easily installed and removed, and it is also very easy to clean.

DRAWING REFERENCE NUMERALS

| | |
|---|---|
| 10. Guard | 11. Sheet |
| 12. Opening | 13. Down-turned Flange |
| 14. Upturned Flange | 15. Tongue |
| 16. Notch | 17. Toilet Rim |
| 18. Toilet | 19. Hinge |
| 20. Toilet Seat | |

DETAILED DESCRIPTION OF THE INVENTION

FIGS. 1–2

Figure 1:
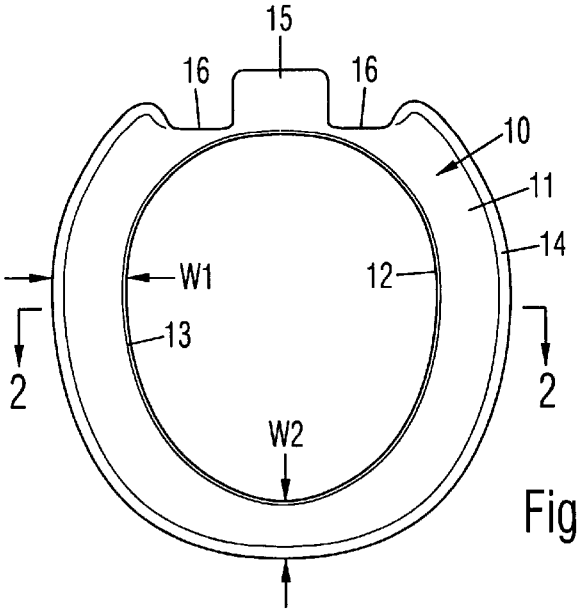
FIG. 1 is a top view of the present toilet drip and splash guard.
Figure 2:
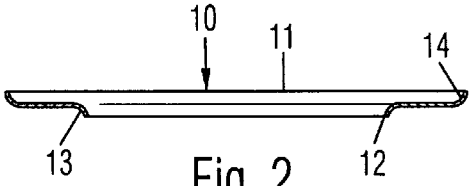
FIG. 2 is a sectional view of the guard taken along line 2—2 in FIG. 1.

A preferred embodiment of a toilet drip and splash guard 10 is shown in a top view in FIG. 1 and a sectional view in FIG. 2. Guard 10 is comprised of a horizontal annular sheet 11 with a central opening 12. Sheet 11 is generally in the shape of a conventional toilet rim. A down-turned flange 13 is arranged at an inner edge of sheet 11, and an upturned flange 14 is arranged at an outer edge of sheet 11. A tongue 15 is arranged at a rear end of sheet 11. A pair of notches 16 are arranged on sheet 11 on opposite sides of tongue 15. Guard 10 is preferably made by forming or stamping a flat cardboard or plastic sheet.

In this example, the sides of guard 10 have a width W1 which is preferably about 3.5 inches (8.9 cm), the front of guard 10 has a width W2 which is preferably about 2.5 inches (6.4 cm), and flanges 13 and 14 are preferably about 0.125 inch (0.31 cm) to 0.25 inch (0.64 cm) tall. Alternatively, guard 10 may be provided with other dimensions. It may also be made of a glow-in-the-dark material for providing an aiming point in the dark and preventing missing the toilet.

FIGS. 3–4

Figure 3:
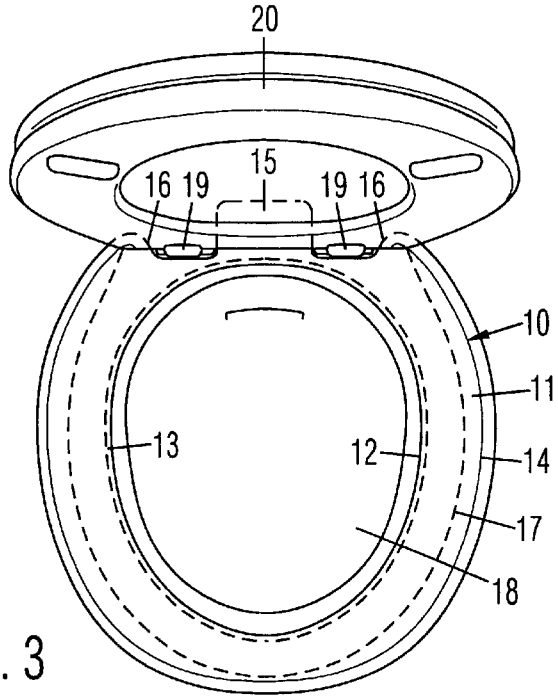
FIG. 3 is a top view of the guard installed on a toilet with a toilet seat in a raised position.
Figure 4:
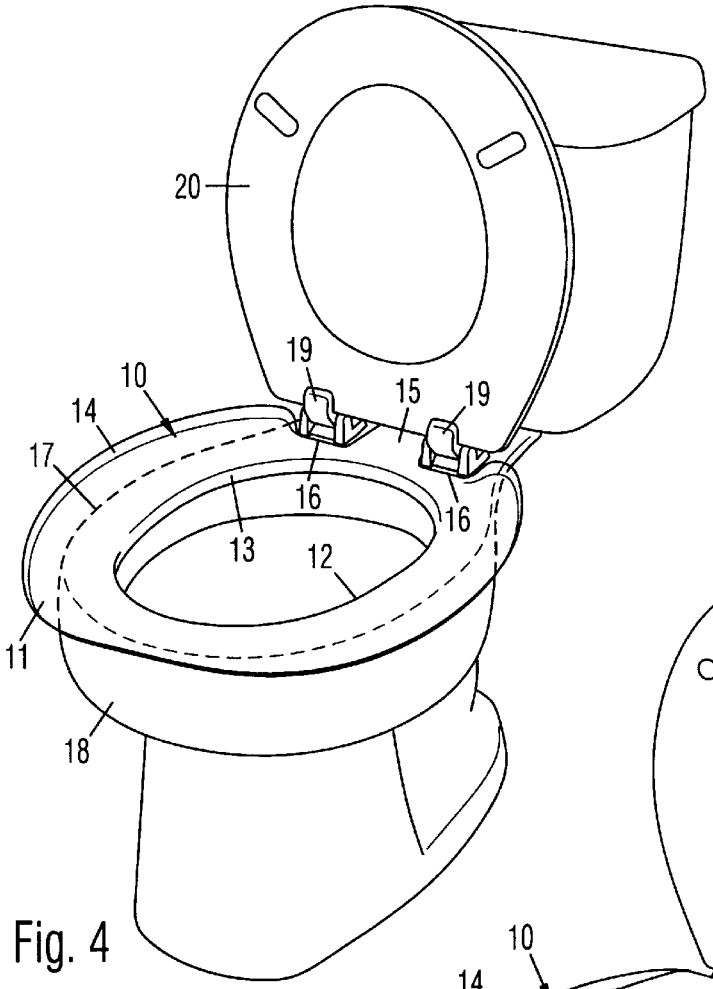
FIG. 4 is a front perspective view of the guard on the toilet with the toilet seat raised.

In FIGS. 3–4, toilet seat 20 is raised, and guard 10 is positioned on a toilet rim 17 of a toilet 18, with tongue 15 inserted between a pair of hinges 19 of toilet seat 20 to prevent guard 10 from rotating. The inner and outer edges of toilet rim 17 are shown in dashed lines in FIG. 3. Notches 16 are respectively positioned around hinges 19 to also prevent guard 10 from rotating. The inner diameter of guard 10 is slightly smaller than an inner diameter of toilet rim 17. Guard 10 is centered about toilet rim 17 by having down-turned flange 13 engaged around the inner edge of toilet rim 17. The entire toilet rim 17 is thus shielded from urine drips and splashes when toilet seat 20 is raised as shown. Guard 10 is easily installed on toilet 18.

The sides of guard 10 are substantially wider than toilet rim 17, so that the outer edge of guard 10 is projected substantially beyond toilet rim 17 for also shielding the floor under toilet 18 from urine drips and splashes. Urine caught by guard 10 is prevented from rolling off by upturned flange 14. Guard 10 is preferably about double the width of toilet rim 17. The front of guard 10 is preferably narrower than the sides to avoid obstructing a user standing in front of the toilet. Guard 10 is at least rigid enough to maintain itself in a horizontal position projecting beyond the outer edge of toilet rim 17.

Guard 10 is easily removed for cleaning. Being removable, guard 10 is much easier to clean than if it is permanently attached to toilet 18. Guard 10 is mostly flat and smooth, so that it is also very easy to clean. Flanges 13 and 14 each has a gentle radii to avoid trapping dried urine and making cleaning easier.

FIG. 5

Figure 5:
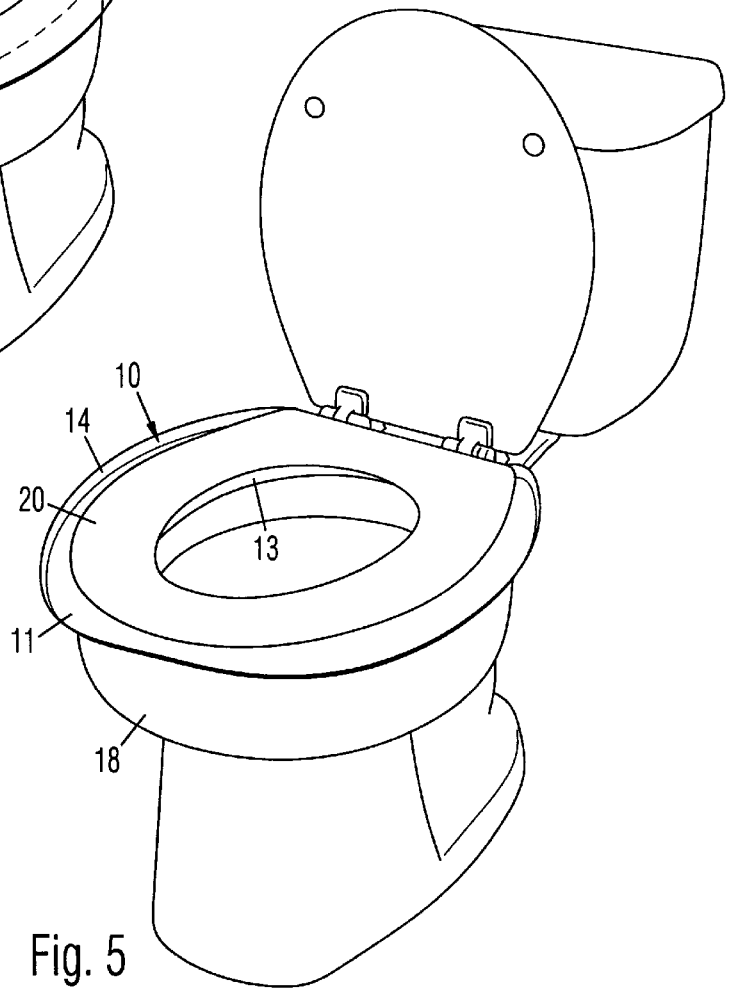
FIG. 5 is a front perspective view of the guard on the toilet with the toilet seat lowered.

In FIG. 5, toilet seat 20 is lowered while guard 10 is still in position. Guard 10 also allows a user to sit on toilet 18 while still in position. Guard 10 is wide enough to project beyond toilet seat 20 to shield the floor from drips and splashes. Guard 10 is extremely simple and economical to produce. It is cheap enough to make and easy enough to install to be disposable for completely eliminating the need for cleaning.

SUMMARY AND SCOPE

Accordingly, the present toilet drip and splash guard shields a toilet rim from dripping and splashing urine. It prevents urine from rolling off onto the toilet rim. It also shields the floor under the toilet from dripping and splashing urine. It allows the toilet seat to be lowered while still in position on the toilet. It does not obstruct a user standing in front or sitting on the toilet. It is very easy to install and remove. It is very easy to clean. It is also very economical to produce.

Although the above description is specific, it should not be considered as a limitation on the scope of the invention, but only as an example of the preferred embodiment. Many variations are possible within the teachings of the invention. Therefore, the scope of the invention should be determined by the appended claims and their legal equivalents, not by the examples given.

I claim:

1. A toilet drip and splash guard, comprising:

a generally rigid annular sheet for being positioned on a toilet rim of a toilet for shielding said toilet rim from urine drips and splashes, a width between an inner edge and an outer edge of said sheet for being at least about twice as wide as said toilet rim, said sheet sized for projecting substantially beyond an outer edge of said toilet rim for also shielding a floor below said toilet from said urine drips and splashes, said sheet being rigid enough to maintain said outer edge of said sheet in a horizontal position projecting beyond said outer edge of said toilet rim;

a central opening on said sheet for enabling urine to pass into said toilet;

and a tongue extending from a rear end of said sheet for being positioned between a pair of hinges of a toilet seat of said toilet and preventing said sheet from rotating, and a pair of notches on said outer end edge of said sheet on opposite sides of said tongue for clearing said hinges of said toilet seat.

2. The toilet drip and splash guard of claim 1, wherein a front of said annular sheet is narrower than a side of said annular sheet for not obstructing a user standing in front of said toilet.

3. The toilet drip and splash guard of claim 1, further including a tongue extending from a rear end of said sheet for being positioned between a pair of hinges of a toilet seat of said toilet, said tongue preventing said sheet from rotating.

4. The toilet drip and splash guard of claim 1, further including a down-turned flange arranged at said inner edge of said sheet for securely engaging an inner edge of said toilet rim.

5. The toilet drip and splash guard of claim 1, further including an upturned flange arranged at said outer edge of said sheet for preventing any urine dripped onto said sheet from rolling off.

6. A toilet drip and splash guard, comprising:

an annular sheet for being positioned on a toilet rim of a toilet for shielding said toilet rim from urine drips and splashes;

a central opening on said sheet for enabling urine to pass into said toilet;

an upturned flange arranged at an outer edge of said sheet for preventing any urine dripped onto said sheet from rolling off;

and a tongue extending from a rear end of said sheet for being positioned between a pair of hinges of a toilet seat of said toilet and preventing said sheet from rotating, and a pair of notches on said outer end edge of said sheet on opposite sides of said tongue for clearing said hinges of said toilet seat.

7. The toilet drip and splash guard of claim 6, wherein a width between an inner edge and said outer edge of said sheet for being at least about twice as wide as said toilet rim, said sheet sized for projecting substantially beyond an outer edge of said toilet rim for also shielding a floor below said toilet from said urine drips and splashes, said sheet being rigid enough to maintain said outer edge of said sheet in a horizontal position projecting beyond said outer edge of said toilet rim.

8. The toilet drip and splash guard of claim 6, wherein a front of said annular sheet is narrower than a side of said annular sheet for not obstructing a user standing in front of said toilet.

9. The toilet drip and splash guard of claim 6, further including a tongue extending from a rear end of said sheet for being positioned between a pair of hinges of a toilet seat of said toilet, said tongue preventing said sheet from rotating.

10. The toilet drip and splash guard of claim 6, further including a down-turned flange arranged at an inner edge of said sheet for securely engaging an inner edge of said toilet rim.

11. A toilet drip and splash guard, comprising:

a generally rigid annular sheet for being positioned on a toilet rim of a toilet for shielding said toilet rim from urine drips and splashes, a width between an inner edge and an outer edge of said sheet for being at least about twice as wide as said toilet rim, said sheet sized for projecting substantially beyond an outer edge of said toilet rim for also shielding a floor below said toilet from said urine drips and splashes, said sheet being rigid enough to maintain said outer edge of said sheet in a horizontal position projecting beyond said outer edge of said toilet rim;

a central opening on said sheet for enabling urine to pass into said toilet;

a down-turned flange arranged at said inner edge of said sheet for securely engaging an inner edge of said toilet rim;

an upturned flange arranged at said outer edge of said sheet for preventing any urine dripped onto said sheet from rolling off;

a tongue extending from a rear end of said sheet for being positioned between a pair of hinges of a toilet seat of said toilet, said tongue preventing said sheet from rotating a pair of notches on said outer end edge of said sheet on opposite sides of said tongue for clearing said hinges of said toilet seat.

12. The toilet drip and splash guard of claim 11, wherein a front of said annular sheet is narrower than a side of said annular sheet for not obstructing a user standing in front of said toilet.

* * * * *